United States Patent [19]

Schemmann et al.

[11] Patent Number: 4,621,423

[45] Date of Patent: Nov. 11, 1986

[54] SHEAR HEAD OF A DRY-SHAVER COMPRISING A SHEAR FOIL WHICH IS CLAMPED SO AS TO BE CURVED

[75] Inventors: Hugo Schemmann, Schaesberg, Netherlands; Romuald L. Bukoschek, Klagenfurt, Austria

[73] Assignee: U.S. Philips Corporation, New York, N.Y.

[21] Appl. No.: 635,392

[22] Filed: Oct. 11, 1984

[30] Foreign Application Priority Data

Nov. 10, 1983 [DE] Fed. Rep. of Germany ..... 3340661

[51] Int. Cl.[4] ..... B26B 19/02

[52] U.S. Cl. ..... 30/43.92; 30/346.51

[58] Field of Search ..... 30/43.92, 43.9, 346.51

[56] References Cited

FOREIGN PATENT DOCUMENTS 136976 10/1979 Japan ..... 30/43.92

*Primary Examiner*—Douglas D. Watts

*Attorney, Agent, or Firm*—Rolf E. Schneider

[57] ABSTRACT

A vibratory dry-shaver comprises a shear foil having two longitudinal edges, and respective means to clamp the two longitudinal edges in place to cause the shear foil to assume a natural curvature, the tangents to such curvature at the two clamping means forming an acute angle with each other. A cutter is reciprocatingly movable along and adjacent to the shear foil, the cutting edge of the cutter having a curvature corresponding to that of the clamped, curved shear foil. The curved shear foil and the cutting edge of the cutter each have a hyperbolic cosine curvature according to the formula:

$$y = c \cdot \cosh x/c$$

where y indicates the distances of the individual cutting edge points from the x-axis, x is the coordinate in the direction of the width of the cutter, and c is a constant derived from the width $2b$ of the clamped shear foil and the height of the curvature h of the clamped shear foil.

2 Claims, 3 Drawing Figures

Figure 1:
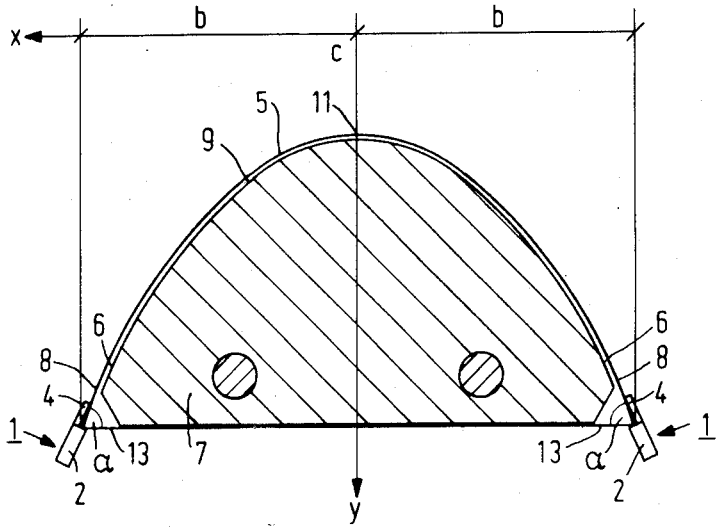

SHEAR HEAD OF A DRY-SHAVER COMPRISING A SHEAR FOIL WHICH IS CLAMPED SO AS TO BE CURVED

This invention relates to a shear head for a dry-shaver comprising a shear foil which is clamped so as to be curved and a cutter adapted to be reciprocatingly moved along and adjacent to the shear foil and likewise curved at the cutting edge, the shear foil being clamped in the proximity of the ends of the cutting range of the cutter and the tangents to the foil curvature at the clamping areas enclosing an acute angle with each other.

Such a shear head is generally known. The shear surface has either a cross-section in the form of an arc of a circle or a semielliptical cross-section (German Pat. No. 932 172). The shear foil is stretched across the cutter. Generally, two substantially strip-shaped contact surfaces are then obtained on either side of the centre of the shear head. These contact surfaces are contracted especially more strongly when the radius of the arc is reduced. In this case, it is possible that the cutter only engages the inner side of the curved shear foil by a single narrow strip. Otherwise, the elliptical form is too narrow in the lower range; the gap between the cutter and the shear foil is unnecessarily large. Especially at the area at which the cutter bends from the foil inwards, a larger amount of wear is obtained.

It is known from U.S. Pat. No. 3,768,348 to increase the pressure of the cutter against the shear foil in order to improve in this manner the engagement between the cutter and the shear foil. However, the increase of the pressure is associated with a larger amount of wear in the preferred engagement and hence shaving ranges. The required driving power of the motor is increased.

It is known from published German Application AS No. 1 056 000 to clamp a shear foil at its clamping edges so that these edges are slightly inclined with respect to each other in the plane of the foil curvature. The cutter, which also consists of a foil and is clamped so as to be curved, is pressed elastically against the lower side of the shear foil. The width of the contact surface between the two cutter foils is comparatively large under no-load conditions, but the cutting effect is unsatisfactory because the cutter partly deflects under pressure during operation.

A foil-shaped cutter is also described in Austrian Pat. No. 292 502. In this case, however, when the shear head is pressed against the skin, the mushroom-shaped cutter foil offers even less resistance. An engagement over a wide surface between the shear foil and the cutter foil is obtained also in this case only under no-load conditions.

The present invention has for its object to increase the contact surfaces between the cutter and the shear foil in spite of a small pressure force, also in the case of narrow shear heads and during operation.

According to the invention, this objective is achieved in that the curvature of the cutting edge of the cutter is adapted substantially over its whole cutting range to the curvature of the shear foil formed automatically solely due to this foil being clamped. Such a measure deviates from the prior art because hitherto the cutter was invariably shaped into a given form, to which the shear foil had to be adapted, whereas according to the invention on the contrary the form of the cutter is adapted to the form assumed by a shear foil which is clamped so as to be curved freely.

Thus, the shear foil engages the cutter substantially by its whole surface. There are no areas of disengagement. The desired curvature of the cutting edge of the cutter is mainly attained if it has a hyperbolic cosine form ($y=c\cdot\cos h\ x/c$) and if the foil edges are clamped tangentially to form a hyperbolic cosine curvature. The main idea is that the current form of the cutter is not forcibly imposed on the shear foil, but that on the contrary the curved form of the rigid cutter, which has been ground into shape, is rather adapted to the clamped form of the shear foil. Such a shear head can operate with a smaller pressure force of the cutter and so requires a lower driving power because the friction can be kept low. The driving power is utilized for shaving and not for heat production. Further, irritations of the skin can be reduced and in general the shaving result is materially improved. The shaving operation yields a higher degree of smoothness—the shaving time becomes shorter and hairs at the neck are cut more thoroughly.

According to a further embodiment of the invention, it is ensured that at a distance 2b between the two clamping areas of approximately $2\times6$ mm the value of the constant is approximately $c=3.5$ mm. The values of c depend upon the foil dimensions.

According to another embodiment of the invention, it is ensured that the constant c is determined by the point of intersection of the functions $$f_1(c)=c+h$$

and $$f_2(c)=c\cdot\cos h\ b/c,$$

where h represents the height of the curvature of the clamped foil between the clamping areas and b represents half the distance between the clamping areas.

Finally, it is advantageous if it is ensured according to a further embodiment of the invention that each clamping area has a clamping wall which engages the clamped shear foil externally immediately adjacent the clamping point, the clamping wall enclosing with connecting line between the clamping areas an angle $\alpha$ of approximately sin h b/c.

Figure 2:
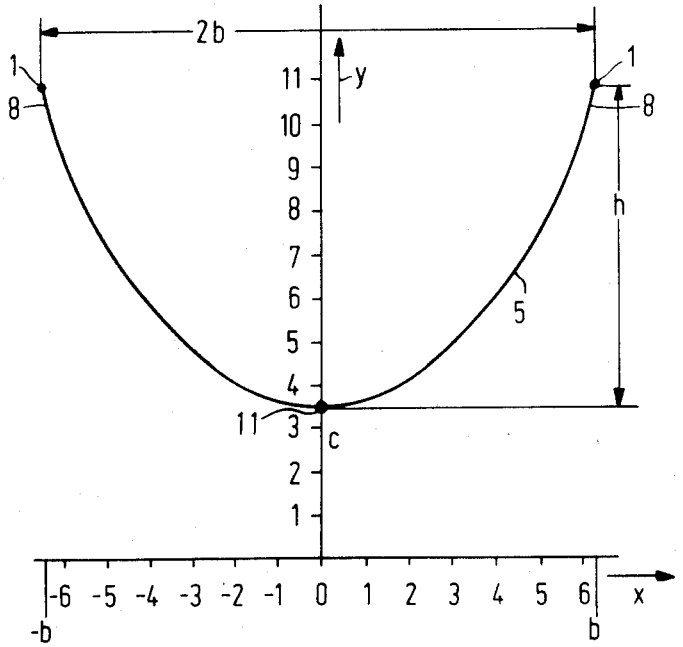
Figure 3:
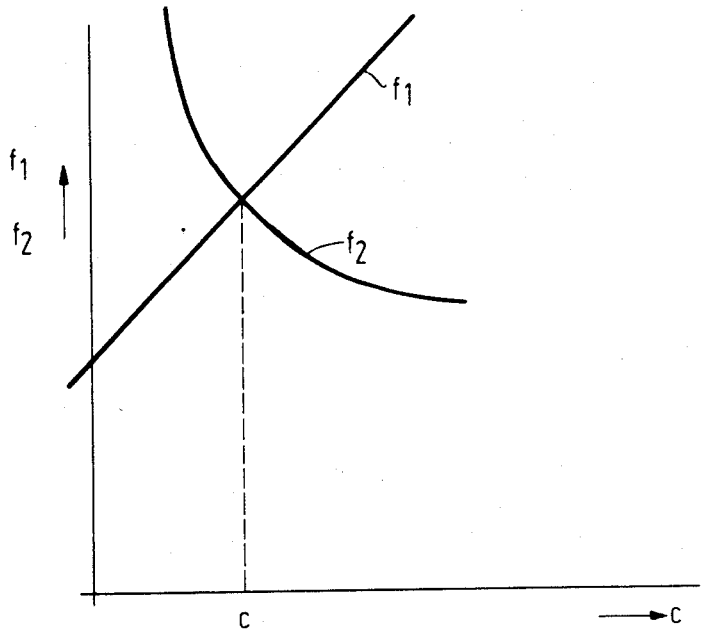

The invention will now be described more fully, with reference to the accompanying drawings, in which:

FIG. 1 is a sectional view of a cutter of a vibratory shaving apparatus having a cutting edge formed with a hyperbolic cosine curvature and a superimposed shear foil, FIGS. 2 and 3 are perspective views for illustrating the dimensioning of the constant c.

FIG. 1 shows a shear foil 5 having two longitudinal edges clamped at the two clamping areas 1 and a cutter 7, of which one blade is shown. The clamping areas 1 each comprise a clamping means 2 having an aligning clamping wall 4 externally engaging the shear foil and clamping the same in the proximity of the ends 6 of the cutting range of the cutter. The cutter has an arcuate cutting edge 9, which follows exactly or approximately the curvature $y=c\cdot\cos h\ x/c$. (The variation of the curve shown in FIG. 1 is not drawn to scale.) In a Cartesian coordinate system, x indicates in the manner shown in FIG. 1 the coordinate in the direction of the width of the cutter 7, while y indicates the distances of the individual cutting edge points from the x-axis. For the determination of the value of the constant c, given parameters of the shear foil should be taken into account. For the determination of c, the starting material is an existing shear foil, which is characterized by its material, its length, its width, its thickness and the holes therein. The clamping edges 8 of such a foil are held over a distance of 2b tangentially to the cos h curve (FIG. 2). The shear foil is then curved according to its construction and its dimensions and assumes a natural hyperbolic cosine curvature inherent to it. The height h of the curvature between the base between the clamping areas 1 and the highest point 11 can be measured. The cutter now should be provided with a cutting edge 9, which corresponds to this natural curvature. This can be achieved in that the line of curvature is copied optically. It has been found that the foil curvature approximately assumes a hyperbolic cosine form. Therefore, the cutting edge should approximate a hyperbolic cosine contour.

The constant c can be formed in the following manner from the values of half the cutter width b (or half the distance between the clamping areas 1) and the height h of the curvature:

The cos h function has the value 1 for x=0;

for x=0 there is thus obtained y=c.

For x=b there is then obtained $$y=c+h=c\cdot\cos h\ b/c.$$

This is a determination equation for c, from which c can be derived. A simple graphical determination method would then be as follows:

The two functions $$f_1(c)=c+h$$

and $$f_2(c)32\ c\cdot\cos h\ b/c$$

are then plotted against c; the point of intersection is determined and thus the special value of c is obtained.

The cutting edge 9 of the cutter 7 is chosen in accordance with this clamping curvature or form of the foil 5 determined by experiments and calculations. When the cutter 7 is shaped in this manner, it is found that the cutter engages over a large surface the inner side of the shear foil 5 without the necessity of exerting a special pressure which would cause the shear foil 5 to be deformed. Substantially no deformation forces are now exerted by the cutter 7 on the shear foil 5.

The shear head is particularly suitable for comparatively narrow constructions. The resulting shave rather resembles a shave by a razor blade, i.e. a shave by one stroke with exact cuts. The shaving operation and the shaving sensation become quite different from those resulting from shear heads of large surface area, in which there is only a limited contact surface between the rigid cutter and the shear foil.

A comparatively narrow shear head is to be understood to mean, for example, a shear head in which the dimension along the x-axis is, for example, about 2×6 mm. The constant c, i.e. the distance between the zero point and the saddle point 11 of the cosinusoidal hyperbolic curve, is, for example, for the shear plate data chosen here 3.5 mm. (In the formula $y=c\cdot\cos h\ x/c$, y invariably indicates the distances of the individual points of the cosinusoidal hyperbolic curve from the x-axis.) The angle $\alpha$ between the clamping edge of the foil and the imaginary connecting line 13 between the clamping points or means is about sin h b/c. In the described embodiment, an angle of about 71.23° is then obtained.

What is claimed is:

1. A vibratory dry-shaver, which comprises a shear foil having two longitudinal edges; respective means to clamp the two longitudinal edges in place to cause the shear foil to assume a natural curvature, the tangents to such curvature at the two clamping means forming an acute angle with each other; and a cutter reciprocatingly movable along and adjacent to the shear foil, the cutting edge of the cutter having been preformed to have a curvature the same as that of the clamped, curved shear foil; the curved shear foil and the cutting edge of the cutter each having a hyperbolic cosine curvature according to the formula:

$$y=c\cdot\cos h\ x/c$$

where y indicates the distances of the individual cutting edge points from the x-axis, x is the coordinate in the direction of the width of the cutter, c is a constant determined by the point of intersection of the functions $$f_1(c)=c+h,$$

and $$f_2(c)=c\cdot\cos h\ b/c$$

b is half the width of the clamped shear foil and h is the height of the curvature of the clamped shear foil.

2. A dry-shaver according to claim 1, in which the clamping means each include a clamping wall externally engaging the clamped shear foil, each clamping wall forming with the imaginary connecting line between the two clamping means an angle $\alpha$ of approximately sin h b/c.

* * * * *